US010408524B2

(12) United States Patent
Djerekarov et al.

(10) Patent No.: US 10,408,524 B2
(45) Date of Patent: Sep. 10, 2019

(54) SYSTEM AND METHOD FOR CONTROLLING THE TEMPERATURE OF A TEMPERATURE CONTROLLED DRAWER

(71) Applicant: General Electric Company, Schenectady, NY (US)

(72) Inventors: Jivko Ognianov Djerekarov, Louisville, KY (US); Jianwu Li, Louisville, KY (US); Stephanos Kyriacou, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 785 days.

(21) Appl. No.: 14/987,822

(22) Filed: Jan. 5, 2016

(65) Prior Publication Data

US 2017/0191731 A1 Jul. 6, 2017

(51) Int. Cl.
*F25D 17/06* (2006.01)
*F25D 25/02* (2006.01)

(52) U.S. Cl.
CPC ..... *F25D 17/065* (2013.01); *F25D 17/067* (2013.01); *F25D 25/02* (2013.01); *F25D 2317/061* (2013.01); *F25D 2317/0681* (2013.01); *F25D 2317/0682* (2013.01); *F25D 2700/121* (2013.01)

(58) Field of Classification Search
CPC ..... F25D 2317/0682; F25D 2700/121
See application file for complete search history.

(56) References Cited

U.S. PATENT DOCUMENTS

2013/0205809 A1 8/2013 Beni et al.
2016/0054047 A1* 2/2016 Lim ..... F25D 17/062 62/419

FOREIGN PATENT DOCUMENTS

JP 2001280748 A 10/2001

* cited by examiner

*Primary Examiner* — Orlando E Aviles
(74) *Attorney, Agent, or Firm* — Dority & Manning, P.A.

(57) ABSTRACT

A refrigerator appliance having a temperature controlled drawer with improved temperature control is provided. A sealed system including a compressor, an evaporator, and an evaporator fan may be configured for cooling the fresh food chamber. A controller is configured to operate the evaporator fan when the compressor is off in order to increase the temperature of the temperature controlled drawer. Additionally, or alternatively, a secondary fan may be attached to the temperature controlled drawer and may be selectively operated by the controller to circulate air from the chilled chamber through the temperature controlled drawer. In this manner, the temperature of the temperature controlled drawer may be more precisely controlled regardless of whether the compressor is running.

15 Claims, 10 Drawing Sheets

SYSTEM AND METHOD FOR CONTROLLING THE TEMPERATURE OF A TEMPERATURE CONTROLLED DRAWER

FIELD OF THE INVENTION

The present subject matter relates generally to refrigerator appliances, and more particularly to controlling the temperature of a temperature controlled drawer within such refrigerator appliances.

BACKGROUND OF THE INVENTION

Certain refrigerator appliances utilize sealed systems for cooling chilled chambers of the refrigerator appliances. A typical sealed system includes a compressor, a condenser, an expansion device, and an evaporator connected in series and charged with a refrigerant. The compressor continuously circulates refrigerant in the sealed system. In the condenser, hot, high pressure gas refrigerant condenses into liquid and expels heat. The liquid refrigerant passes through the expansion device where it rapidly expands and passes into the evaporator as a two-phase refrigerant. A fan may circulate air through the cold evaporator before delivering the cooled air through an opening into the chilled chamber. Air from the chilled chamber is circulated back through a return duct to be re-cooled by the sealed system. The process is repeated to maintain the chilled chamber at the desired temperature.

In some refrigerator appliances, a temperature controlled drawer may be positioned at the bottom of a fresh food chamber. The temperature controlled drawer may include controls to enable more precise control of the temperature within the drawer, and temperature sensitive foods may be placed in the drawer to prolong their shelf life. However, the location of the temperature controlled drawer within the fresh food chamber may lead to difficulty in maintaining a desired temperature within the drawer. For example, when the evaporator fan is turned off, cool air tends to settle near the bottom of the fresh food chamber, while hot air rises to the top.

In addition, the fresh food chamber evaporator is typically positioned just outside the bottom, back corner of the fresh food chamber. The evaporator may therefore be positioned immediately adjacent the temperature controlled drawer, and may cause undesirable or excessive cooling of the temperature controlled drawer. This is especially true in refrigerators equipped with dual evaporators connected in series—e.g., one for the fresh food chamber and one for the freezer chamber. During the freezer only cooling cycle, the fresh food evaporator stays cold because refrigerant is flowing, but no air is circulated through it. As a result, the temperature controlled drawer may get too cold due to conduction from the fresh food evaporator. For these reasons, the temperature controlled drawer is often the coldest portion of the fresh food chamber.

Conventional refrigerator appliances control the temperature of the temperature controlled drawer by using a fan and damper mechanism tied to the fresh food evaporator. When cooling is required, the damper opens to draw cold air from the evaporator into the temperature controlled drawer. When heating is required, a heater may be used to increase the temperature of the temperature controlled drawer. These configurations require additional components, more complicated assembly, and increased cost. Increased system complexity also leads to decreased reliability and increased service costs during the life of the refrigerator appliance.

Accordingly, a refrigerator appliance including a temperature controlled drawer having improved temperature control would be useful. More particularly, a refrigerator appliance enabling precise control of the temperature in the temperature controlled drawer independently of the operation of the fresh food evaporator would be especially beneficial.

BRIEF DESCRIPTION OF THE INVENTION

The present subject matter provides a refrigerator appliance having a temperature controlled drawer with improved temperature control. A sealed system including a compressor, an evaporator, and an evaporator fan may be configured for cooling the fresh food chamber. A controller is configured to operate the evaporator fan when the compressor is off in order to increase the temperature of the temperature controlled drawer. Additionally, or alternatively, a secondary fan may be attached to the temperature controlled drawer and may be selectively operated by the controller to circulate air from the chilled chamber through the temperature controlled drawer. In this manner, the temperature of the temperature controlled drawer may be more precisely controlled regardless of whether the compressor is running, and without requiring additional components, such as a heater or dampen. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet defining a fresh food chamber and a door being rotatably hinged to the cabinet to provide selective access to the fresh food chamber. A sealed system including a compressor, an evaporator, and an evaporator fan positioned adjacent the evaporator may be configured for urging chilled air through the evaporator into the fresh food chamber. A temperature controlled drawer may be disposed within the fresh food chamber and a controller may be configured to selectively operate the evaporator fan when the compressor is not operating, such that the temperature in the temperature controlled drawer is increased.

According to another exemplary embodiment, a refrigerator appliance is provided. The refrigerator appliance may define a vertical direction, a lateral direction, and a transverse direction, and may include a cabinet defining a chilled chamber and a door being rotatably hinged to the cabinet to provide selective access to the chilled chamber. A sealed system comprising a compressor, an evaporator positioned proximate a bottom back side of the chilled chamber, and an evaporator fan positioned adjacent the evaporator may be configured for urging chilled air through the evaporator into the chilled chamber. A temperature controlled drawer may be disposed near a bottom of the chilled chamber proximate the evaporator and a secondary fan may be attached to the temperature controlled drawer and configured to circulate air from the chilled chamber through the temperature controlled drawer. A controller may be configured to selectively operate the evaporator fan and the secondary fan to maintain a desired temperature in the temperature controlled drawer.

According to yet another exemplary embodiment, a method of controlling the temperature of a temperature controlled drawer in a chilled chamber of a refrigerator appliance is provided. The method includes providing a sealed system comprising a compressor, an evaporator, and an evaporator fan, the evaporator fan being configured for urging chilled air through the evaporator and into the chilled chamber. The method also includes providing a temperature controlled drawer within the chilled chamber and providing a secondary fan attached to the temperature controlled drawer. The evaporator fan and the secondary fan may be selectively operated to circulate air from the chilled chamber through the temperature controlled drawer and maintain a desired temperature in the temperature controlled drawer.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including best mode thereof, directed to one of ordinary skill in the art, is set forth in the specification, which makes reference to the appended figures.

DETAILED DESCRIPTION

Figure 1:
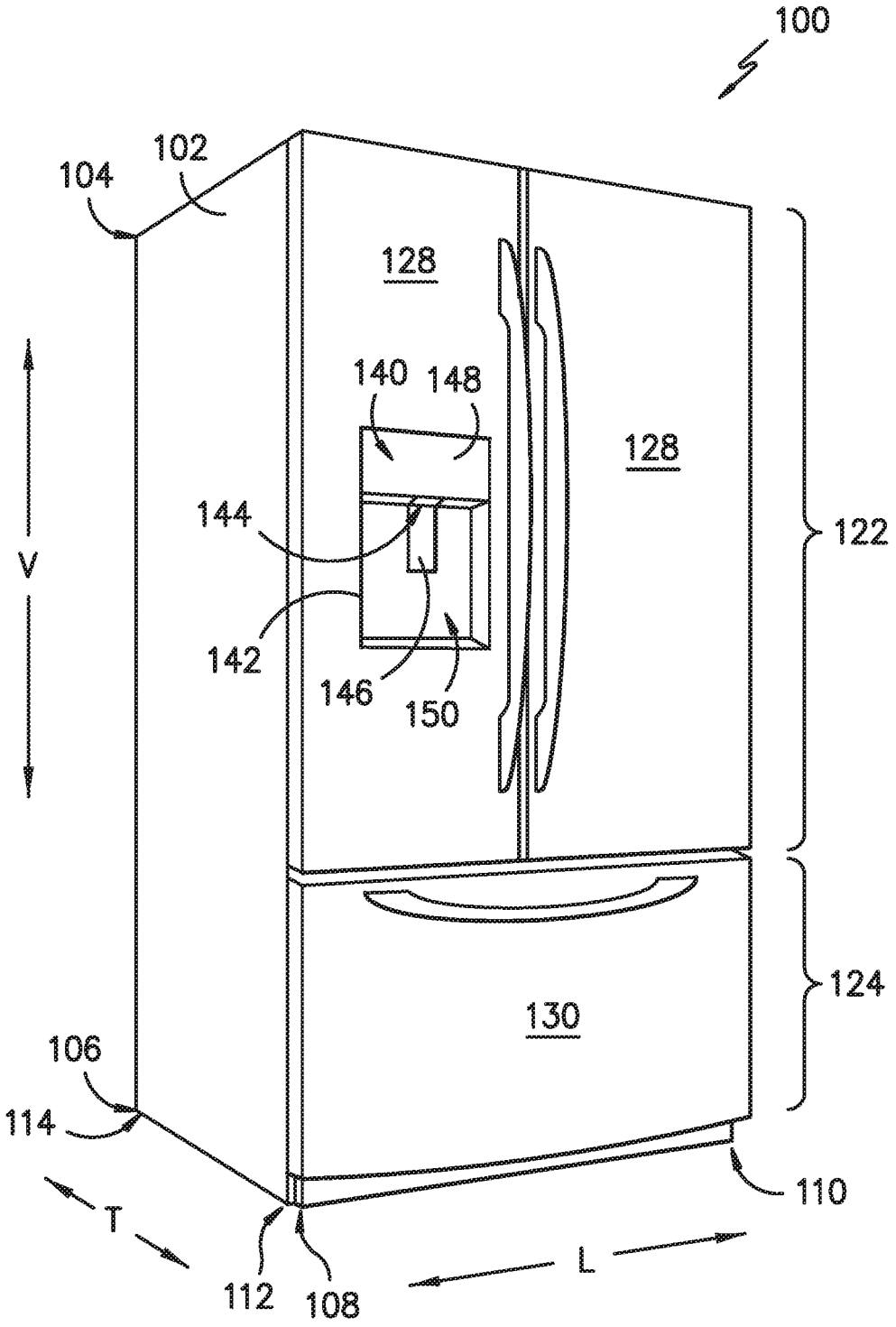
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. Refrigerator door 128 may define an icebox compartment housing an icemaker and an ice storage bin (not shown) that are configured to supply ice to dispenser recess 150.

Figure 2:
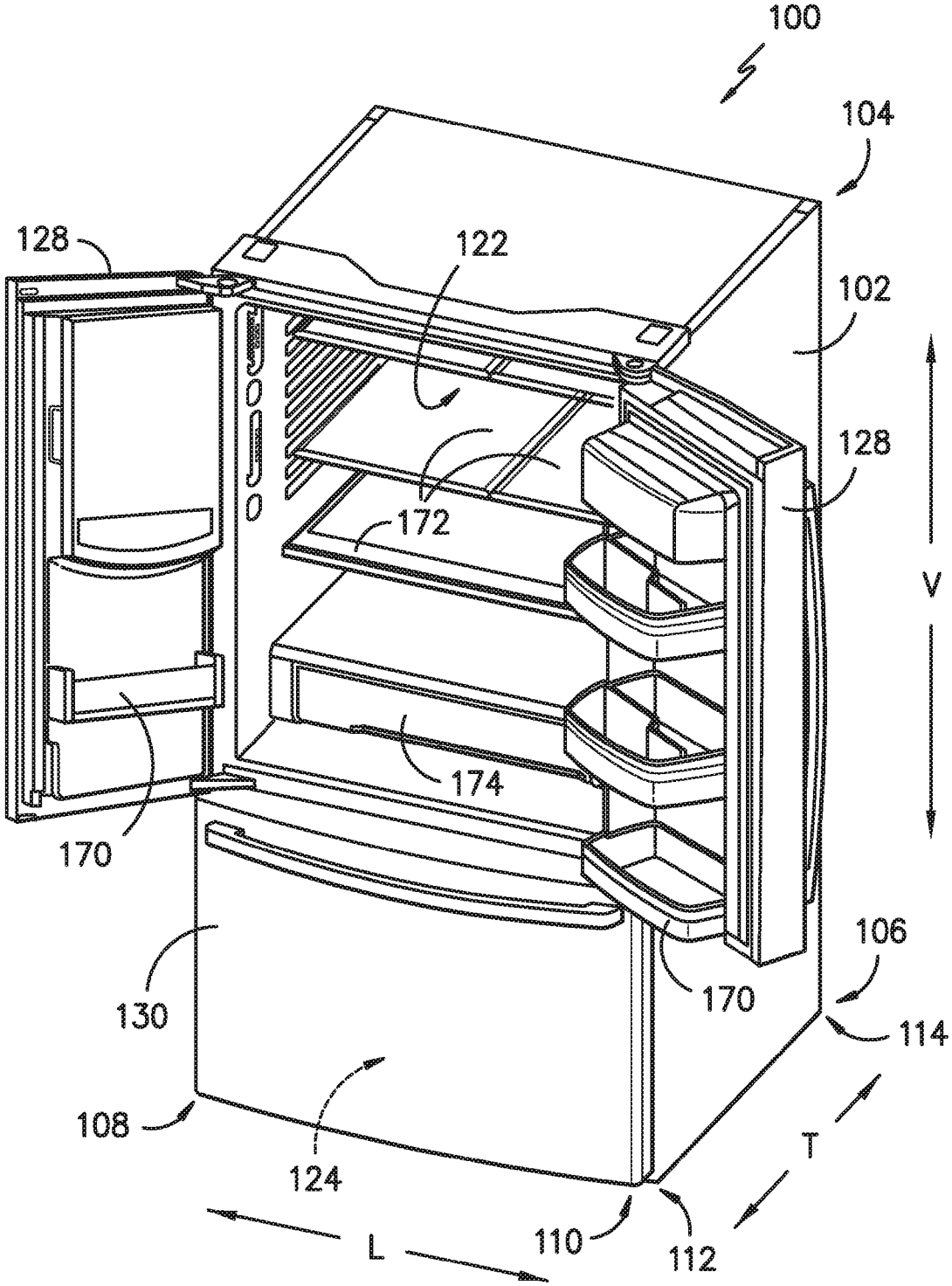
FIG. 2 provides a perspective view of the exemplary refrigerator appliance of FIG. 1 with refrigerator doors shown in an open position to reveal a fresh food chamber of the refrigerator appliance.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 170, shelves 172, and a temperature controlled drawer 174 that are mounted within fresh food chamber 122.

Bins 170, shelves 172, and temperature controlled drawer 174 are configured for receipt of food items (e.g., beverages and/or solid food items) and may assist with organizing such food items. As will be described in detail below, temperature controlled drawer 174 may include features to enable precise temperature control within temperature controlled drawer 174. In this manner, temperature controlled drawer 174 can, for example, receive fresh food items (e.g., vegetables, fruits, and/or cheeses) and increase the useful life of such fresh food items.

Figure 3:
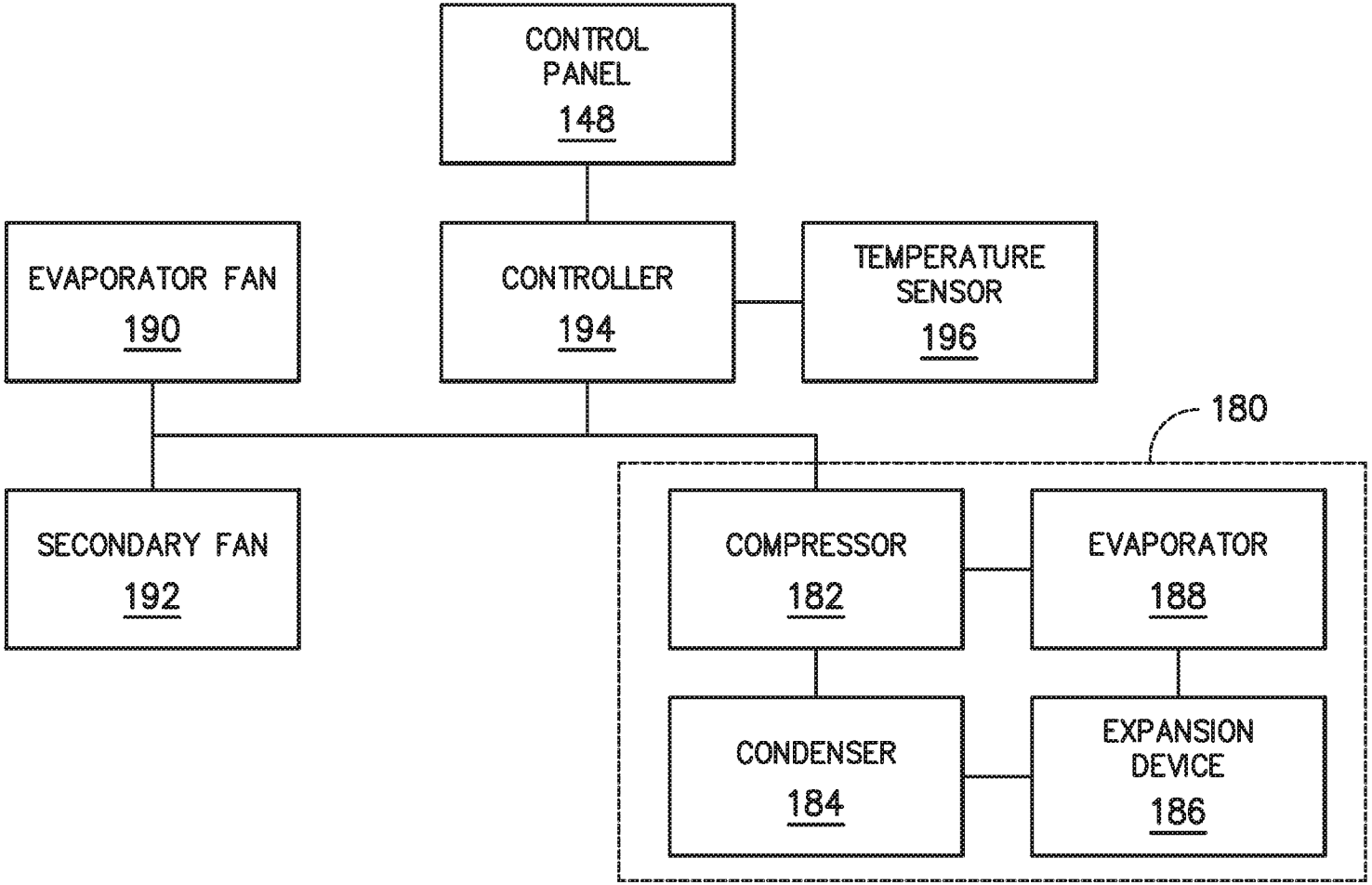
FIG. 3 provides a schematic view of a sealed cooling system of the refrigerator appliance of FIG. 1.

FIG. 3 provides a schematic view of certain components of refrigerator appliance 100. As may be seen in FIG. 3, refrigerator appliance 100 includes a sealed cooling system 180 for executing a vapor compression cycle for cooling air within refrigerator appliance 100, e.g., within fresh food chamber 122 and freezer chamber 124. Sealed cooling system 180 includes a compressor 182, a condenser 184, an expansion device 186, and an evaporator 188 connected in series and charged with a refrigerant. As will be understood by those skilled in the art, sealed cooling system 180 may include additional components, e.g., at least one additional evaporator, compressor, expansion device, and/or condenser. As an example, sealed cooling system 180 may include two evaporators.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange with ambient air takes place so as to cool the refrigerant and cause the refrigerant to condense to a liquid state.

Expansion device (e.g., a valve, capillary tube, or other restriction device) 186 receives liquid refrigerant from condenser 184. From expansion device 186, the liquid refrigerant enters evaporator 188. Upon exiting expansion device 186 and entering evaporator 188, the liquid refrigerant drops in pressure and vaporizes. Due to the pressure drop and phase change of the refrigerant, evaporator 188 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 188 is a type of heat exchanger which transfers heat from air passing over evaporator 188 to refrigerant flowing through evaporator 188.

Refrigerator appliance 100 also includes an evaporator fan 190. As discussed in more detail below, evaporator fan 190 is configured for urging a flow of chilled air through evaporator 188 into fresh food chamber 122 through a chilled air duct. The chilled air lowers the temperature in fresh food chamber 122 before passing through a return duct (not shown) back to the sealed cooling system 180. In this manner, the sealed cooling system 180 distributes chilled air throughout the fresh food chamber 122 to maintain the temperature at a desired set point. According to an exemplary embodiment, refrigerator appliance 100 may further include a secondary fan 192 whose operation will be described in detail below. Evaporator fan 190 and secondary fan 192 may be axial fans, centrifugal fans, or any other device suitable for moving air.

Refrigerator appliance 100 further includes a controller 194. Operation of the refrigerator appliance 100 is regulated by controller 194 that is operatively coupled to control panel 148. In one exemplary embodiment, control panel 148 may represent a general purpose I/O ("GPIO") device or functional block. In another exemplary embodiment, control panel 148 may include input components, such as one or more of a variety of electrical, mechanical or electromechanical input devices including rotary dials, push buttons, touch pads, and touch screens. Control panel 148 may be in communication with controller 194 via one or more signal lines or shared communication busses. Control panel 148 provides selections for user manipulation of the operation of refrigerator appliance 100. In response to user manipulation of the control panel 148, controller 194 operates various components of refrigerator appliance 100. For example, controller 194 is operatively coupled or in communication with compressor 182, evaporator fan 190, and secondary fan 192 such that controller 194 can operate such components.

Figure 6:
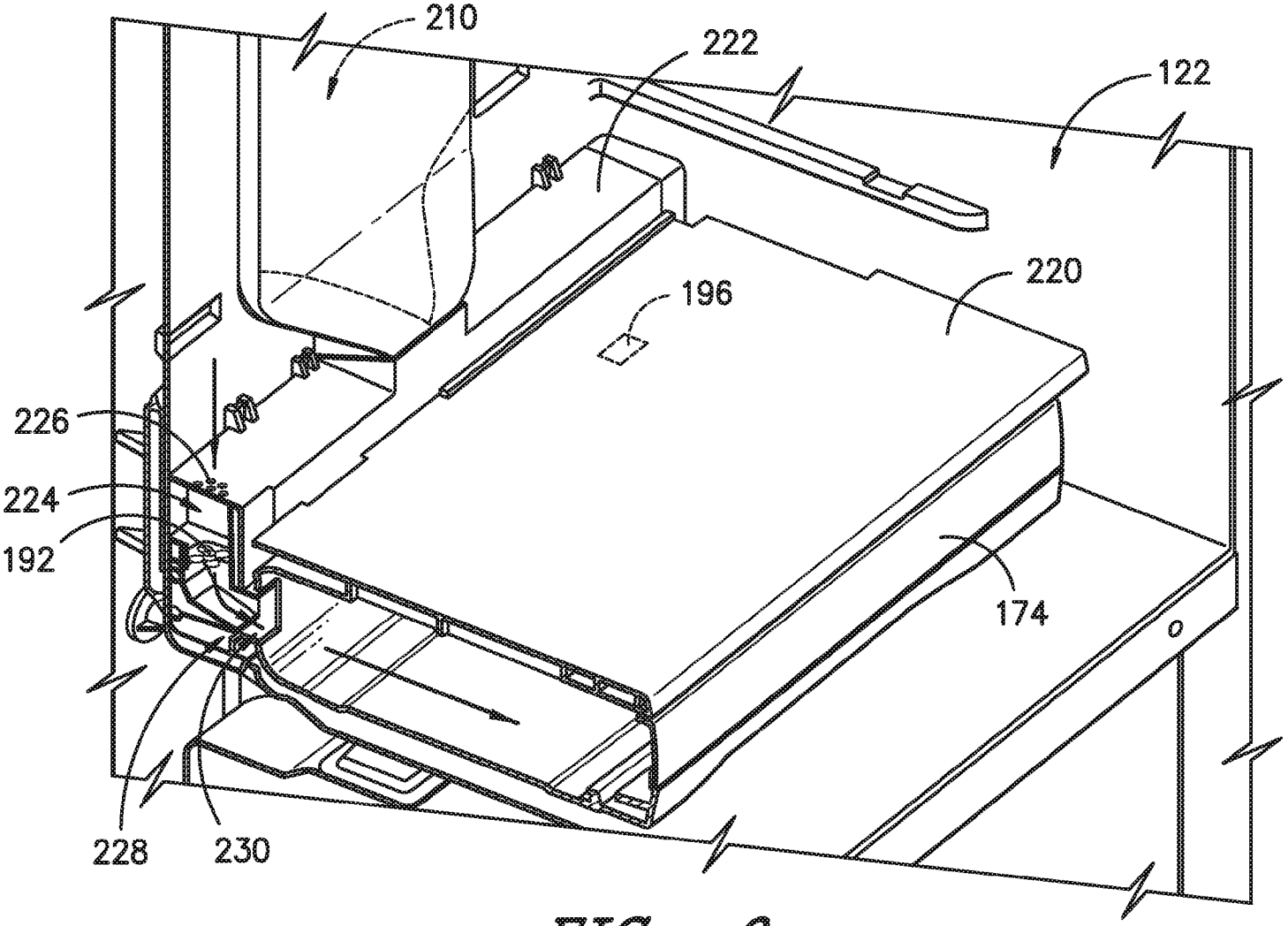
FIG. 6 provides a perspective, cross sectional view of a temperature controlled drawer of the exemplary refrigerator appliance of FIG. 1.

Controller 194 may also be in communication with a variety of sensors, such as, for example, a temperature sensor 196. As shown in FIG. 6, temperature sensor 196 may be positioned within temperature controlled drawer 174. Temperature sensor 196 may be a thermistor, a thermocouple, or any other device suitable for accurately measuring the temperature of temperature controlled drawer 174. Controller 194 may receive signals from temperature sensor 196 that correspond to a temperature of an atmosphere or air within temperature controlled drawer 174.

Controller 194 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 194 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 4:
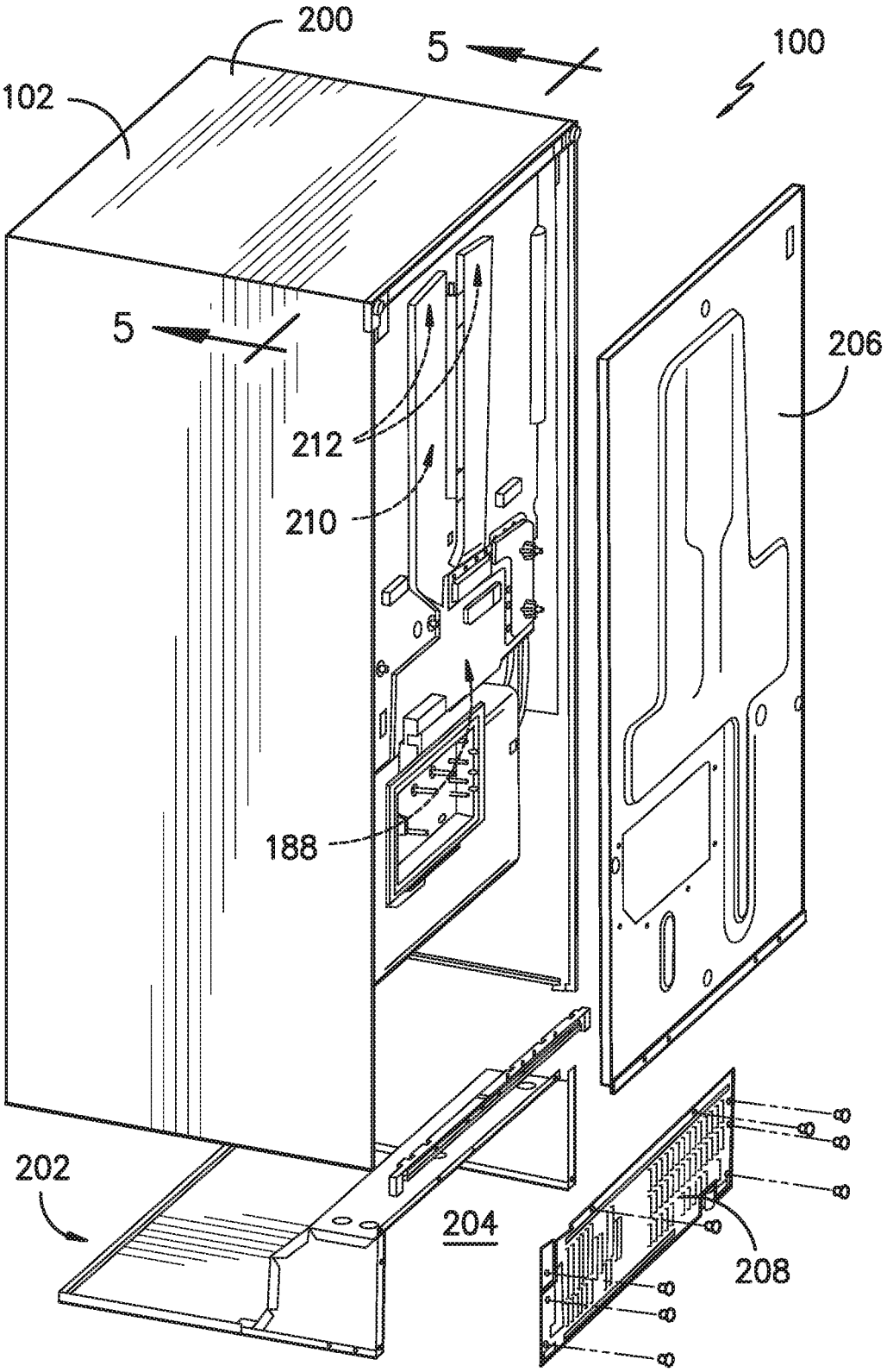
FIG. 4 provides an exploded perspective view of the refrigerator appliance of FIG. 1.

Referring now to FIG. 4, an exploded, back side view of housing 102 of refrigerator appliance 100 is provided. Housing 102 generally includes a main body 200, which may be integral, and thus formed from a single component, or may be separate components that are connected together, such as via suitable mechanical fasteners (such as screws, rivets, nut-bolt combinations, etc), bonding, etc. Housing 102 may further include housing bottom 202, which may be assembled to main body 200 via suitable mechanical fasteners (such as screws, rivets, nut-bolt combinations, etc), bonding, etc. Housing bottom 202 may define a machinery compartment 204 for housing, e.g., some components of sealed system 180.

Housing 102 may additionally include a back panel 206, which may be connected to main body 200 via suitable mechanical fasteners (such as screws, rivets, nut-bolt combinations, etc), bonding, etc. Further, housing 102 may additionally include a machinery compartment cover plate 208. Cover plate 208 may be connected to housing bottom 202 via suitable mechanical fasteners (such as screws, rivets, nut-bolt combinations, etc), bonding, etc.

As mentioned above, evaporator fan 190 may be configured for urging a flow of chilled air through evaporator 188 into fresh food chamber 122. More particularly, referring FIGS. 4 and 5, evaporator fan 190 can be positioned within a chilled air duct 210 to force chilled air into the fresh food chamber 122 through chilled air inlet 212. The approximate location of evaporator 188, chilled air duct 210, and chilled air inlet 212 are indicated by dotted line in FIG. 4. Notably, chilled air inlet 212 is positioned near top 104 of refrigerator appliance 100.

Figure 5:
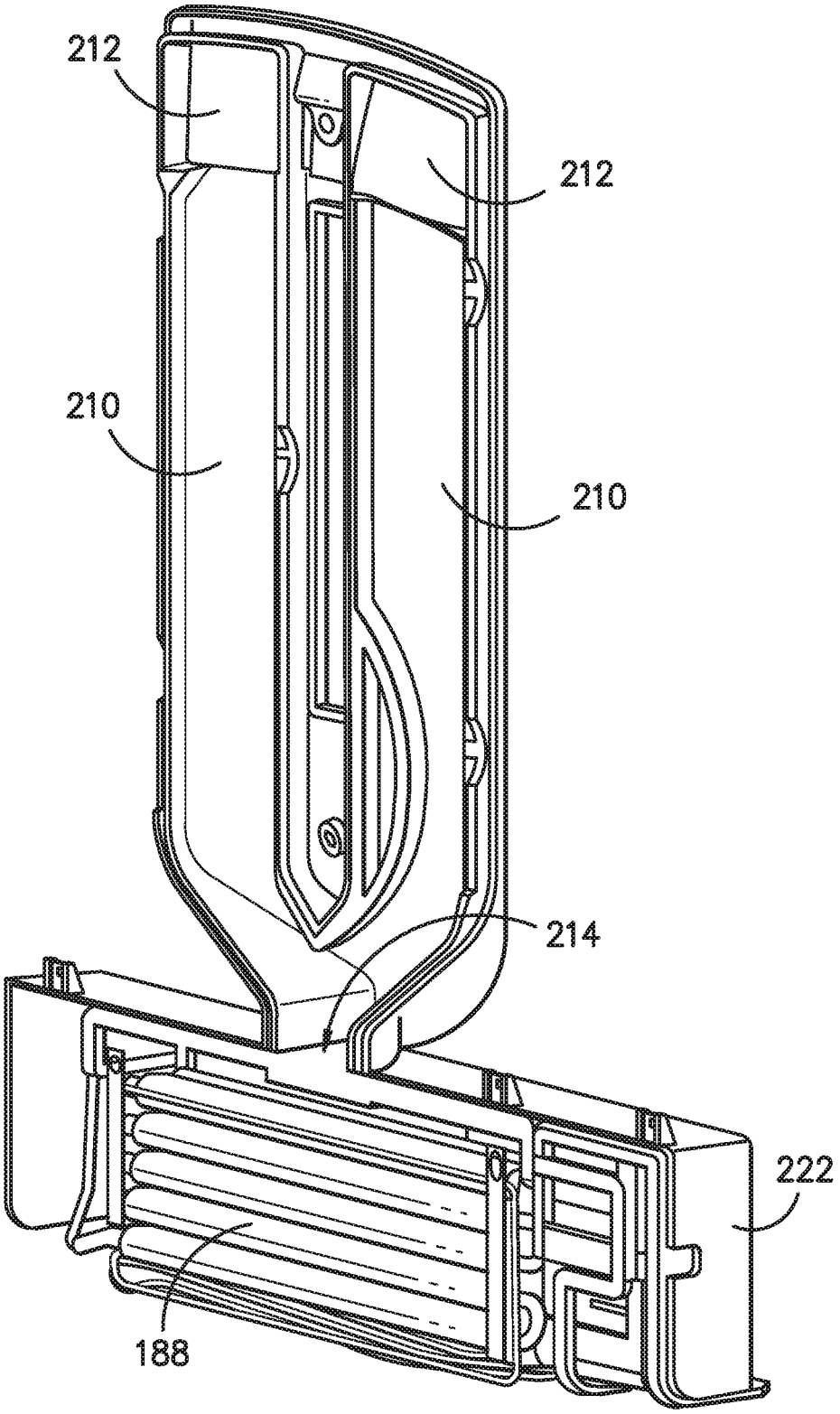
FIG. 5 provides a perspective, cross sectional view of part of the sealed cooling system of the exemplary refrigerator appliance of FIG. 1, as taken along Line 5-5 of FIG. 4.

FIG. 5 provides a perspective view of evaporator 188, chilled air duct 210, and chilled air inlet 212, as taken along Line 5-5 of FIG. 4. Evaporator fan 190 is not shown for clarity in FIG. 5, but may be located in opening 214 to draw air through evaporator 188. One skilled in the art will appreciate that the positioning of evaporator fan 190 in opening 214 is only one exemplary position, and that evaporator fan 190 may also be placed in other suitable locations within refrigerator appliance.

Referring now to FIG. 6, temperature controlled drawer 174 will be described in more detail. As shown, temperature controlled drawer 174 may be disposed within fresh food chamber 122. Temperature controlled drawer 174 may be movable along the transverse direction T between an open and a closed position. According to the illustrated embodiment, temperature controlled drawer 174 includes a bottom and four sides. A shelf 220 may define the top side of temperature controlled drawer 174. Shelf 220 may be fixed within fresh food chamber 122 and may be at least partially made out of tempered glass or transparent plastic.

According to the exemplary embodiment illustrated in FIG. 6, a manifold 222 may be positioned on the back wall of fresh food chamber 122 behind temperature controlled drawer 174. A portion of manifold 222 may define a space outside fresh food chamber 122 for housing evaporator 188 and evaporator fan 190. In addition, manifold 222 may also define a conduit 224 for circulating air between fresh food chamber 122 and temperature controlled drawer 174. More particularly, conduit may extend from an inlet 226 through manifold 222 to an outlet 228. Outlet 228 may align with an aperture 230 defined in the back side of temperature controlled drawer 174. In this manner, when temperature controlled drawer 174 is in the closed position, outlet 228 and aperture 230 place fresh food chamber 122 and temperature controlled drawer 174 in flow communication.

According to the illustrated embodiment, secondary fan 192 may be positioned within conduit 224 for circulating air between fresh food chamber 122 and temperature controlled drawer 174. According to an another exemplary embodiment, secondary fan 192 may be disposed within shelf 220 to place temperature controlled drawer 174 in flow communication with fresh food chamber 122. Other locations for secondary fan 192 are also contemplated. Indeed, secondary fan 192 may be positioned anywhere suitable for placing fresh food chamber 122 in flow communication with temperature controlled drawer 174.

Although the exemplary embodiment shown in FIG. 6 illustrates air flowing into temperature controlled drawer 174, one skilled in the art will appreciate that secondary fan 192 may be reversed to instead circulate air in the opposite direction according to some embodiments. One skilled in the art will appreciate that the configuration of temperature controlled drawer described above is used only as an example. Modifications and variations may be applied, other configurations may be used, and the resulting configurations may remain within the scope of the invention.

Figure 7:
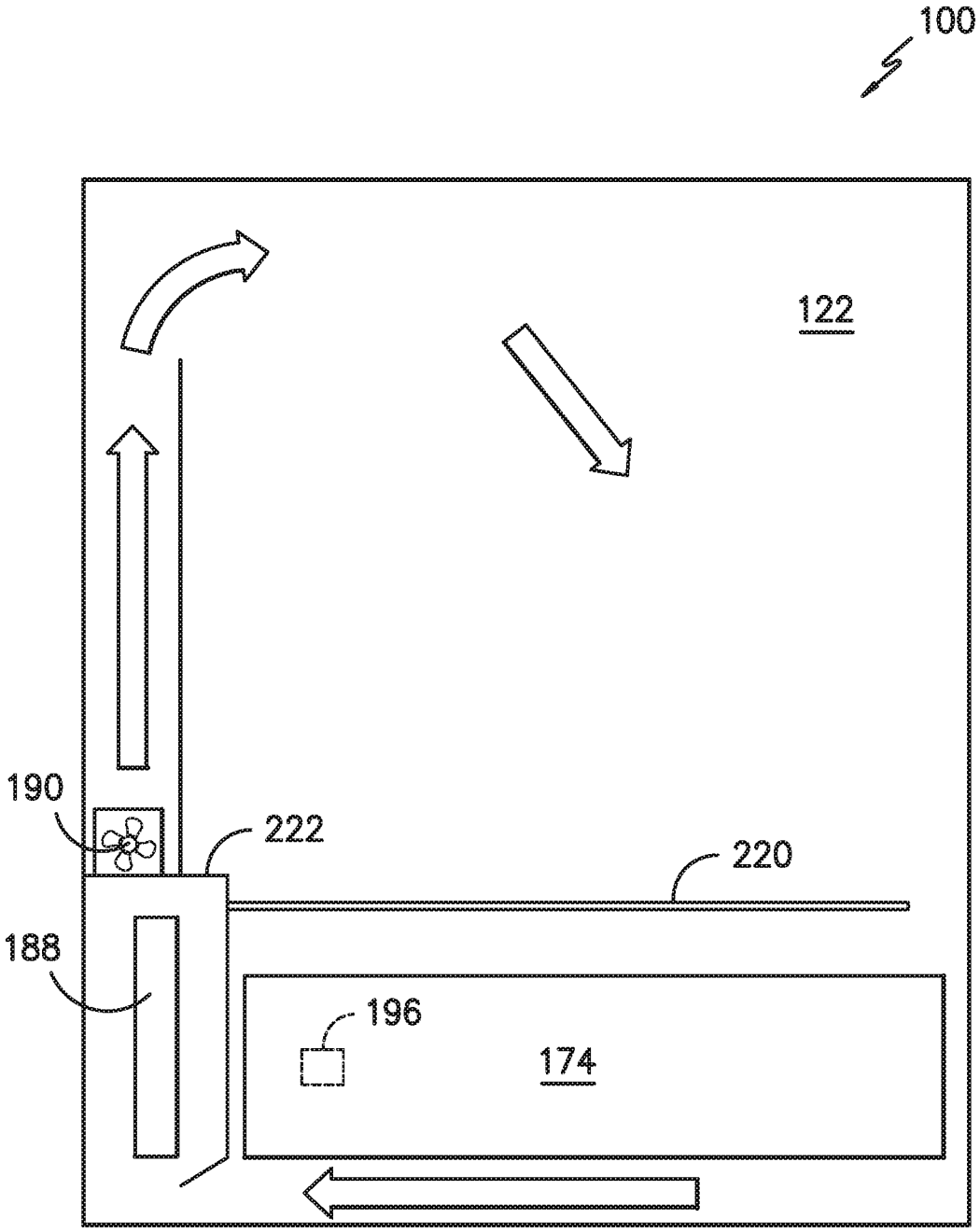
FIG. 7 provides a schematic side view of the operation of the exemplary refrigerator appliance of FIG. 1 when only the evaporator fan is operating.
Figure 8:
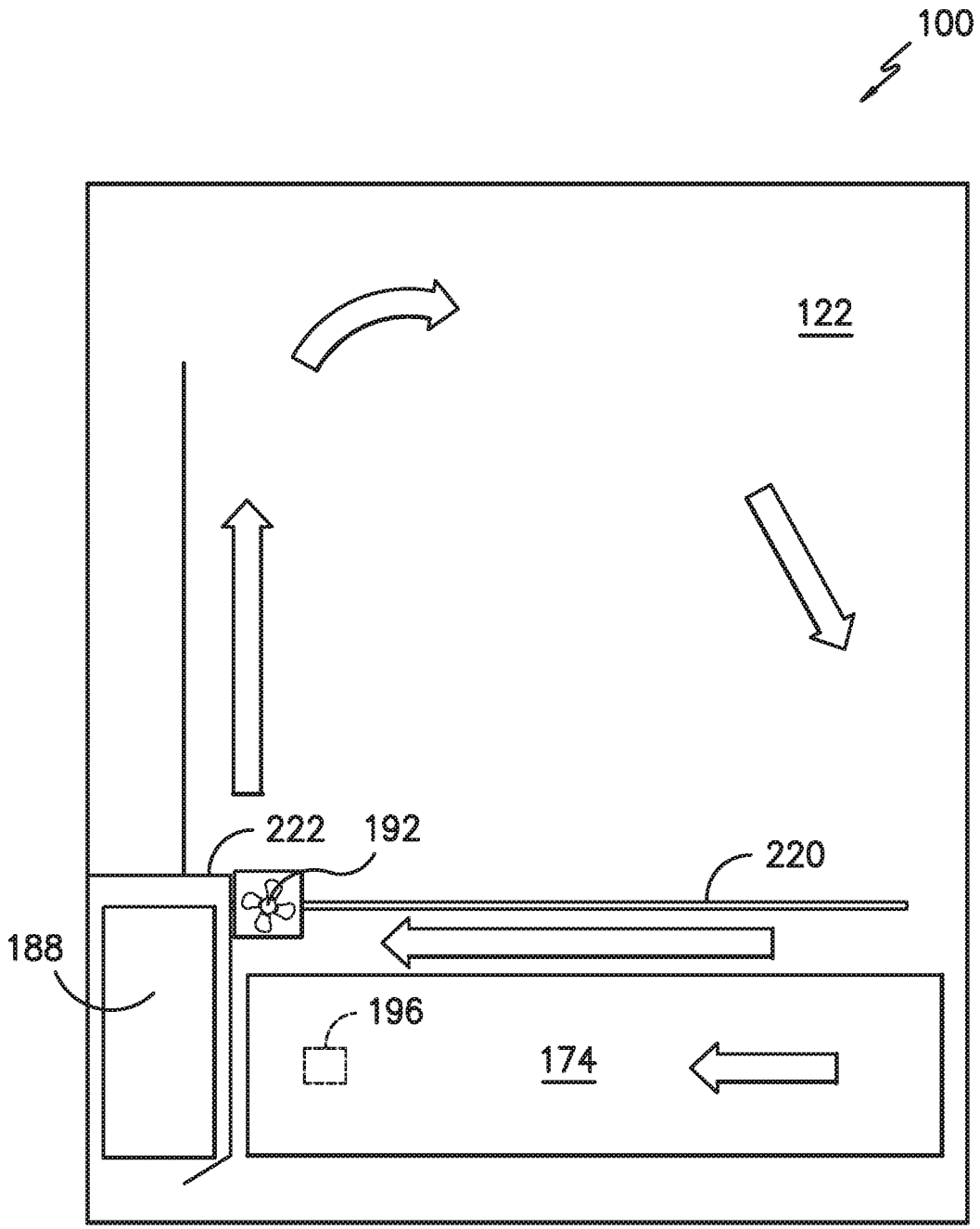
FIG. 8 provides a schematic side view of the operation of the exemplary refrigerator appliance of FIG. 1 when only the secondary fan is operating.
Figure 9:
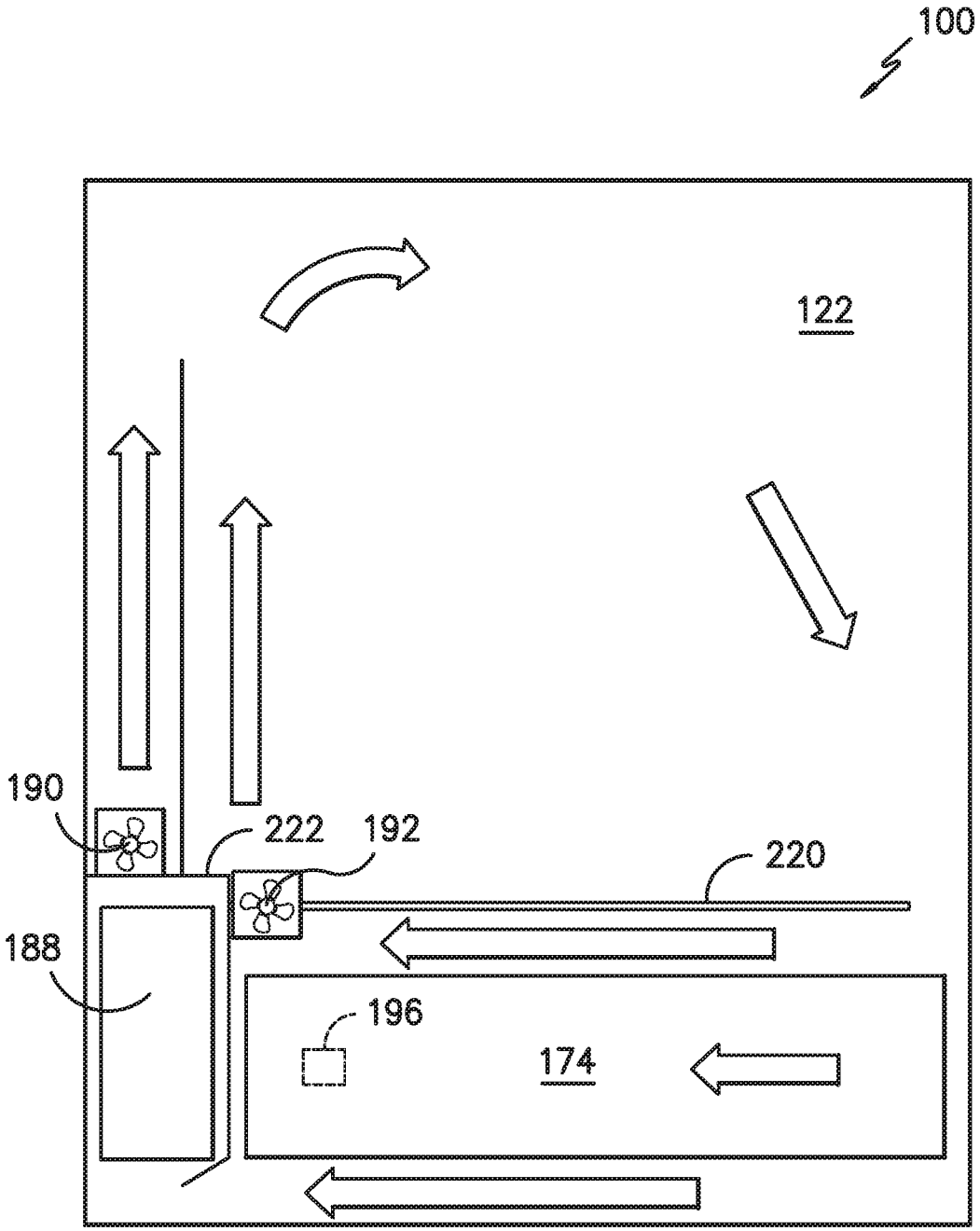
FIG. 9 provides a schematic side view of the operation of the exemplary refrigerator appliance of FIG. 1 when both the evaporator fan and the secondary fan are operating.

Referring now to FIGS. 7 through 9, schematic side views of refrigerator appliance 100 during three exemplary modes of operation are provided. For example, referring to FIG. 7, only evaporator fan 190 is operating to circulate air through evaporator 188, into fresh food chamber 122, and through a return duct. Notably, controller 194 may operate evaporator fan 190 either when compressor 182 is on or off, for example, to prevent settling of cold air at the bottom of fresh food chamber 122. As shown in FIG. 8, secondary fan 192 is operating independently to circulate air within fresh food compartment 122. Notably, secondary fan 192 may operate regardless of whether compressor 182 and/or evaporator fan 190 are operating to increase the temperature of temperature controlled drawer 174. FIG. 9 illustrates operation of both evaporator fan 190 and secondary fan 192 to provide improved air circulation within fresh food chamber 122. Therefore, evaporator fan 190 and secondary fan 192 may operate simultaneously or independently to provide improved versatility and temperature control of temperature controlled drawer 174.

Now that the construction of refrigerator appliance 100 having a temperature controlled drawer 174 according to an exemplary embodiment has been presented, an exemplary method 300 of controlling the temperature of temperature controlled drawer 174 will be described. Although the discussion below refers to the exemplary method 300 of operating refrigerator appliance 100, one skilled in the art will appreciate that the exemplary method 300 is applicable to the operation of a variety of other refrigerator appliances having different configurations. For example, it should be understood that method 300 may be used, for example, in top mount refrigerators, side-by-side refrigerators, or any other appliance where it is desirable to maintain precise temperature control of a chilled chamber.

Figure 10:
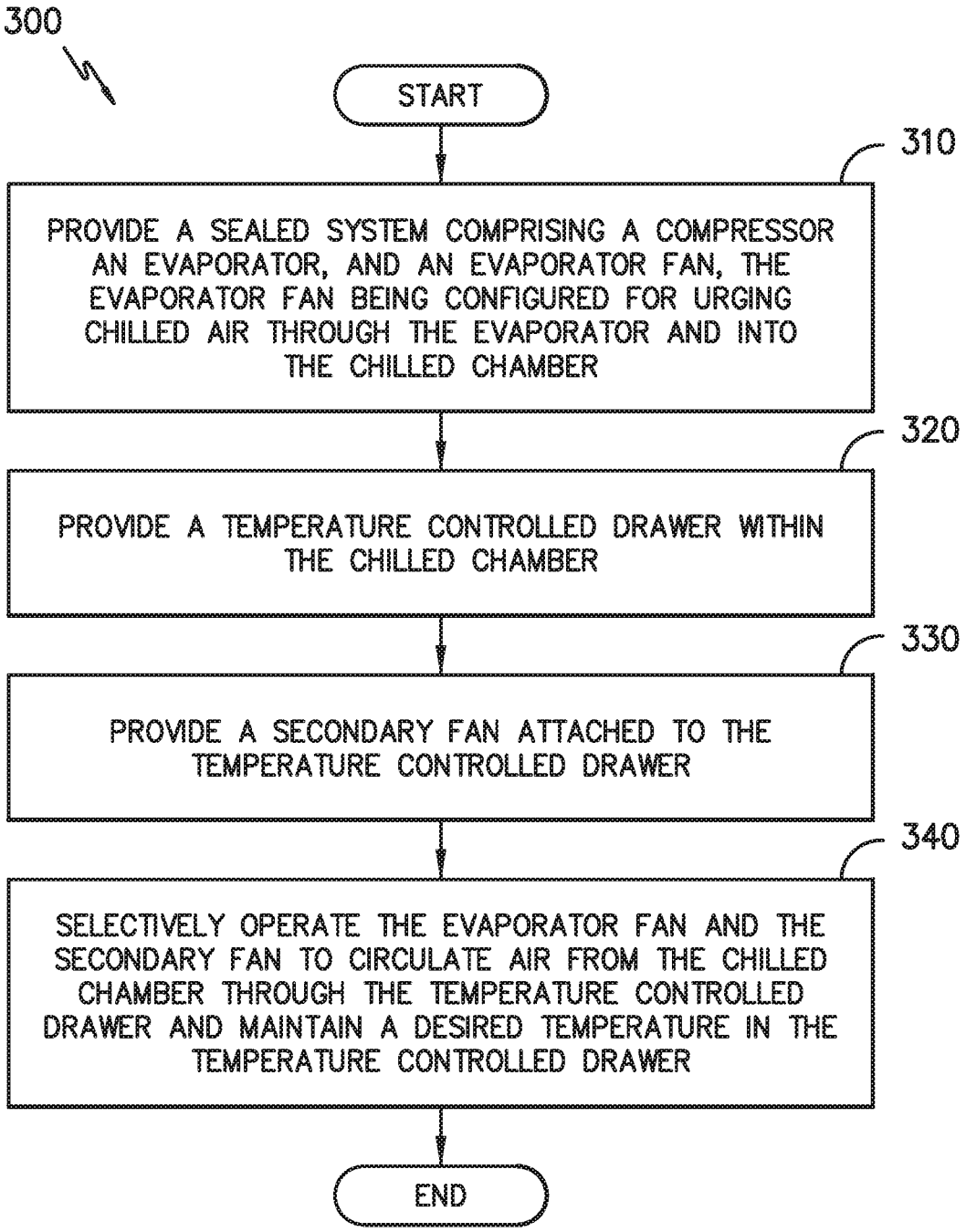
FIG. 10 illustrates a method for controlling the temperature of the temperature controlled drawer according to an exemplary embodiment of the present disclosure.

Referring now to FIG. 10, method 300 includes, at step 310, providing a sealed system including a compressor, an evaporator, and an evaporator fan, the evaporator fan being configured for urging chilled air through the evaporator and into the chilled chamber. At step 320, a temperature controlled drawer is provided within the chilled chamber, and at step 330, a secondary fan is attached to the temperature controlled drawer. Step 340 includes selectively operating the evaporator fan and the secondary fan to circulate air from the chilled chamber through the temperature controlled drawer and maintain a desired temperature in the temperature controlled drawer.

Using refrigerator appliance 100 as an example, controller 194 may be configured to implement method 300. In this manner, controller 194 may be configured to selectively operate evaporator fan 190 when compressor 182 is not operating, such that the temperature control in temperature controlled drawer 174 is increased. To ensure accurate temperature, controller 194 may be configured to selectively operate the evaporator fan 190 in response to a measured temperature by temperature sensor 196. Notably, controller 194 may operate evaporator fan 190 and secondary fan 192 simultaneously or independently of each other. In this manner, versatility in temperature control of temperature controlled drawer 174 may be achieved.

For example, when compressor 182 is off, the temperature of temperature controlled drawer 174 may drop because cold air tends to settle near temperature controlled drawer 174 and hot air tends to rise to the top of fresh food chamber 122 if the air is not properly circulated. In addition, if evaporator 188 is still cool, the temperature of temperature controlled drawer 174 may drop due to conduction from evaporator 188. Therefore, when compressor 182 is off, controller 194 may selectively operate the evaporator fan 190 to circulate air and raise the temperature of temperature controlled drawer 174 by circulating warmer air from the top of fresh food chamber 122.

By contrast, if compressor 182 is on and evaporator 188 is cool, but fresh food chamber 122 is already at the desired temperature, it would not be desirable to cool fresh food chamber 122 further by operating evaporator fan 190, which would circulate cool air through evaporator 188 into fresh food compartment 122. Instead, secondary fan 192 may be operated to circulate air within fresh food chamber 122 without further cooling the entire fresh food chamber 122 by urging air through evaporator 188.

According to another exemplary embodiment, both evaporator fan 190 and secondary fan 192 may operate simultaneously to ensure that the warmer air at the top of the fresh food chamber 122 is circulated through the temperature controlled drawer 174 to increase its temperature. In this manner, air circulation within fresh food chamber 122 may be improved. One skilled in the art will appreciate that the above described refrigerator appliance 100 may be operated in many ways not described herein, and such operation may fall within the scope of the present invention.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a fresh food chamber;

a door being rotatably hinged to the cabinet to provide selective access to the fresh food chamber;

a sealed system comprising a compressor, an evaporator, and an evaporator fan positioned adjacent the evaporator for urging chilled air through the evaporator into the fresh food chamber;

a temperature controlled drawer disposed within the fresh food chamber;

a shelf disposed above the temperature controlled drawer;

a secondary fan disposed within the shelf and providing flow communication between the temperature controlled drawer and the fresh food chamber;

a temperature sensor disposed within the fresh food chamber; and a controller configured to selectively rotate the evaporator fan to circulate air when the compressor is not operating and in response to a measured temperature by the temperature sensor, such that the temperature in the temperature controlled drawer is increased.

2. The refrigerator appliance of claim 1, wherein the temperature sensor disposed within the temperature controlled drawer.

3. The refrigerator appliance of claim 1, wherein the temperature sensor is a thermistor.

4. The refrigerator appliance of claim 1, wherein the controller is configured to selectively operate the secondary fan independently of the evaporator fan to increase the temperature in the temperature controlled drawer.

5. The refrigerator appliance of claim 1, further comprising a fan manifold defined at least in part by a front wall that extends vertically between the temperature controlled drawer and the evaporator, the fan manifold defining a conduit, wherein the secondary fan is disposed within the conduit for circulating air from the fresh food chamber through the temperature controlled drawer.

6. The refrigerator appliance of claim 1, wherein the temperature controlled drawer is disposed near a bottom of the fresh food chamber near the evaporator.

7. A refrigerator appliance defining a vertical direction, a lateral direction, and a transverse direction, the refrigerator appliance comprising:

a cabinet defining a chilled chamber;

a door being rotatably hinged to the cabinet to provide selective access to the chilled chamber;

a sealed system comprising a compressor, an evaporator positioned proximate a bottom back side of the chilled chamber, and an evaporator fan positioned adjacent the evaporator for urging chilled air through the evaporator into the chilled chamber;

a temperature controlled drawer disposed near a bottom of the chilled chamber proximate the evaporator;

a shelf disposed above the temperature controlled drawer;

a secondary fan disposed within the shelf and providing flow communication between the temperature controlled drawer and the chilled chamber to circulate air from the chilled chamber through the temperature controlled drawer; and a controller configured to selectively rotate the evaporator fan while the compressor is off and the secondary fan to maintain a desired temperature in the temperature controlled drawer.

8. The refrigerator appliance of claim 7, further comprising a temperature sensor disposed within the temperature controlled drawer, wherein the controller is configured to selectively operate the evaporator fan and the secondary fan in response to a measured temperature by the temperature sensor.

9. The refrigerator appliance of claim 8, wherein the temperature sensor is a thermistor.

10. The refrigerator appliance of claim 7, further comprising a fan manifold defined at least in part by a front wall that extends vertically between the temperature controlled drawer and the evaporator, the fan manifold defining a conduit for circulating air into the temperature controlled drawer.

11. The refrigerator appliance of claim 10, wherein the temperature controlled drawer defines an air intake port and the conduit extends from an air inlet proximate the chilled chamber to an air outlet, the air intake port and the air outlet being in flow communication when the temperature controlled drawer is in a closed position.

12. A method of controlling the temperature of a temperature controlled drawer in a chilled chamber of a refrigerator appliance, the method comprising:

providing a sealed system comprising a compressor, an evaporator, and an evaporator fan, the evaporator fan being configured for urging chilled air through the evaporator and into the chilled chamber;

providing a temperature controlled drawer within the chilled chamber;

providing a secondary fan within a shelf disposed above the temperature controlled drawer to provide flow communication between the temperature controlled drawer and the chilled chamber; and selectively rotating the evaporator fan while the compressor is off and the secondary fan to circulate air from the chilled chamber through the temperature controlled drawer and maintain a desired temperature in the temperature controlled drawer.

13. The method of claim 12, wherein the secondary fan is selectively operated independently of the evaporator fan to increase the temperature in the temperature controlled drawer.

14. The method of claim 12, further comprising a temperature sensor disposed within the temperature controlled drawer, wherein the evaporator fan and the secondary fan are selectively operated in response to a measured temperature by the temperature sensor.

15. The method of claim 14, wherein the temperature sensor is a thermistor.

* * * * *